US007073684B2

(12) United States Patent
Decker et al.

(10) Patent No.: US 7,073,684 B2
(45) Date of Patent: Jul. 11, 2006

(54) DISPENSER FOR HOUSING A PLURALITY OF FOLDED WET WIPES

(75) Inventors: Christopher Vincent Decker, Appleton, WI (US); Christopher Michael Bechyne, Appleton, WI (US); Stephen Robert Kehn, Appleton, WI (US); Cleary E. Mahaffey, Appleton, WI (US); Herb Flores Velazquez, Neenah, WI (US); John Martin Wydeven, Little Chute, WI (US); Yung Hsiang Huang, Appleton, WI (US)

(73) Assignee: Kimberly-Clark Wordwide, Inc., Neenah, WI (US)

( * ) Notice: Subject to any disclaimer, the term of this patent is extended or adjusted under 35 U.S.C. 154(b) by 139 days.

(21) Appl. No.: 10/810,129

(22) Filed: Mar. 26, 2004

(65) Prior Publication Data

US 2005/0211716 A1 Sep. 29, 2005

(51) Int. Cl.
*B65H 1/00* (2006.01)

(52) U.S. Cl. ..... 221/63

(58) Field of Classification Search ..... 204/494
See application file for complete search history.

(56) References Cited

U.S. PATENT DOCUMENTS

| | | | | |
|---|---|---|---|---|
| 2,619,226 | A | 11/1952 | Adams | |
| 3,780,908 | A | 12/1973 | Fitzpatrick et al. | |
| 3,819,043 | A | 6/1974 | Harrison | |
| 3,967,756 | A | 7/1976 | Barish | |
| D244,583 | S | 6/1977 | Barish | |
| 4,138,034 | A | 2/1979 | McCarthy | |
| 4,328,917 | A | 5/1982 | Reeberg | |
| 4,487,328 | A | 12/1984 | Wilcox et al. | |
| 4,570,820 | A | 2/1986 | Murphy | |
| 4,735,317 | A | 4/1988 | Sussman et al. | |
| 4,739,900 | A | 4/1988 | Borst | |
| D295,830 | S | 5/1988 | Holly | |
| D295,961 | S | 5/1988 | Holly | |
| 4,854,473 | A | 8/1989 | Dubach | |
| 4,865,221 | A * | 9/1989 | Jackson et al. | 221/48 |
| D311,334 | S | 10/1990 | Flynn et al. | |
| 5,037,000 | A | 8/1991 | Selame | |
| 5,040,680 | A | 8/1991 | Wilson et al. | |
| 5,076,465 | A | 12/1991 | Lawson | |
| D330,913 | S | 11/1992 | Hiromori | |
| D365,755 | S | 1/1996 | Kanfer et al. | |

(Continued)

FOREIGN PATENT DOCUMENTS

CA 2013794 A1 10/1990

(Continued)

*Primary Examiner*—Gene O. Crawford
*Assistant Examiner*—Timothy Waggoner
(74) *Attorney, Agent, or Firm*—Thomas J. Connelly

(57) ABSTRACT

A dispenser is disclosed which can house a plurality of folded wet wipes, each having a width. The dispenser includes first and second members pivotally connected together to form an enclosed dispenser having a transverse axis. The first and second members are formed from a semi-rigid material. The dispenser has a height of about 2.5 inches or less and has a top wall with an entrance formed therein. The entrance has a surface area of from between about 15 $cm^2$ to about 95 $cm^2$. The folded wet wipes having a normalized separation force between two adjacent sheets of less than about 65 g/cm. The entrance also has a dimension measured along the transverse axis that when divided by the width of one of the folded wet wipes is at least about 0.7.

21 Claims, 4 Drawing Sheets

U.S. PATENT DOCUMENTS

| | | | | |
|---|---|---|---|---|
| D367,609 | S | 3/1996 | Frank et al. | |
| 5,540,332 | A | 7/1996 | Kopacz et al. | |
| 5,542,567 | A | 8/1996 | Julius | |
| D374,774 | S | 10/1996 | Cassel | |
| 5,573,132 | A | 11/1996 | Kanfer et al. | |
| 5,647,506 | A | 7/1997 | Julius | |
| 5,699,912 | A | 12/1997 | Ishikawa et al. | |
| 5,735,087 | A | 4/1998 | Olden | |
| 5,810,200 | A | 9/1998 | Trokhan | |
| 6,019,510 | A | 2/2000 | Gonzalez et al. | |
| 6,092,690 | A * | 7/2000 | Bitowft et al. | 220/831 |
| 6,158,614 | A | 12/2000 | Haines et al. | |
| 6,206,221 | B1 | 3/2001 | Bando et al. | |
| 6,213,300 | B1 | 4/2001 | Flaig et al. | |
| D443,450 | S | 6/2001 | Ruhotas et al. | |
| 6,250,495 | B1 | 6/2001 | Bando | |
| D450,960 | S | 11/2001 | Boyea et al. | |
| 6,364,101 | B1 | 4/2002 | Schultz | |
| 6,394,298 | B1 | 5/2002 | Zaidman | |
| D461,403 | S | 8/2002 | Chomik et al. | |
| D465,685 | S | 11/2002 | Dellerman et al. | |
| 6,523,690 | B1 * | 2/2003 | Buck et al. | 206/494 |
| D473,740 | S | 4/2003 | Ruhotas et al. | |
| 6,550,634 | B1 | 4/2003 | Alegre De Miquel et al. | |
| 6,609,616 | B1 | 8/2003 | Dilnik et al. | |
| 6,729,498 | B1 * | 5/2004 | Yelton et al. | 221/63 |
| 6,758,369 | B1 * | 7/2004 | Morin et al. | 221/48 |
| 6,964,726 | B1 * | 11/2005 | Chen et al. | 162/134 |
| 2002/0192433 | A1 | 12/2002 | Huang et al. | |
| 2003/0010789 | A1 | 1/2003 | Sosalia et al. | |
| 2004/0115393 | A1 | 6/2004 | Vogel et al. | |
| 2005/0211717 | A1 | 9/2005 | Decker et al. | |
| 2005/0211718 | A1 | 9/2005 | Decker et al. | |

FOREIGN PATENT DOCUMENTS

| | | | |
|---|---|---|---|
| CA | 2195211 | A1 | 11/1996 |
| CA | 2329789 | A1 | 11/1999 |
| CA | 2351853 | A1 | 6/2000 |
| CA | 2377683 | A1 | 1/2001 |
| CA | 2349604 | A1 | 3/2001 |
| CA | 2189431 | C | 10/2001 |
| CA | 2218649 | C | 12/2002 |
| EP | 0 697 344 | A1 | 2/1996 |
| EP | 0738667 | B1 | 7/1999 |
| EP | 1 129 656 | A1 | 9/2001 |
| EP | 0968934 | B1 | 2/2003 |
| EP | 1131257 | B1 | 4/2003 |
| WO | WO 97/39964 | A1 | 10/1997 |
| WO | WO 99/29602 | A1 | 6/1999 |
| WO | WO 99/55213 | A1 | 11/1999 |
| WO | WO 03/002416 | A2 | 1/2003 |

* cited by examiner

DISPENSER FOR HOUSING A PLURALITY OF FOLDED WET WIPES

BACKGROUND OF THE INVENTION

Wet wipes are available in a variety of shapes, sizes and compositions. One common wet wipe is a pre-moistened, disposable towelettes. Such wet wipes can be utilized in a variety of applications both domestic and industrial and can perform a variety of functions. Wet wipes are typically used to wipe surfaces both animate and inanimate, and may provide numerous benefits such as cleaning, cleansing, disinfecting, and skin care benefits. One particular application of wet wipes is for wiping parts of a human body particularly when wash water is not available, for example when traveling. Wet wipes are also commonly used for human cleansing and wiping in general such as anal, perineal and genital cleansing, and face and hand cleansing. One example of such a wet wipe is an intimate feminine hygiene wipe. Wet wipes may also be used for application of substances to the body including removing or applying make-up, skin conditioners and medications. Other applications for wet wipes include wiping the buttock of a baby during diaper changes and for the treatment of adult and baby dermatitis partly caused by the use of diapers and incontinence undergarments. In addition, wet wipes can be used for wiping and or cleaning other surfaces or for the application of compositions to surfaces. For example, wet wipes can be used to wipe kitchen and bathroom surfaces, eyeglasses, shoes and surfaces which require cleaning in industry. Examples of wet wipes in industrial applications include cleaning surfaces of tools, machinery, contaminated, dirty or greasy parts and materials, etc. Wet wipes can also be used for the cleaning or grooming of household pets, like cats and dogs.

Various dispenser designs are commercially available today for housing, storing and dispensing such wet wipes. Some are large tubs or flexible packages that are several inches in vertical height. Such larger dispensers are designed to hold over eighty wet wipes. Other designs include slim travel dispensers or travel packs that can contain less than twenty five wet wipes. Some dispensers allow for removal of an individual wet wipe while others permit multiple wet wipes to be simultaneously withdrawn from the dispenser. One issue with many dispensers is the lack of ease in removing a single wet wipe with one hand. For example, a mother in the act of changing an infant's diaper may be required to use her right hand to hold the baby still while using only her left hand to open and grab a wet wipe. Under such conditions, the consumer needs to be able to readily pick up and separate one wet wipe from the stack and remove the wet wipe from the dispenser using only one hand and without causing the dispenser to be raised up from the surface on which it is placed during the removal process.

The problem of not being able to easily dispense a single wet wipe from the stack and remove it from the dispenser is due to a number of reasons. First, each wet wipe sheet is commonly bi-folded or tri-folded and then placed one on top of another to form a stack. Many times, the wet wipe sheets are folded, nested, interleaved or joined to an adjacent wet wipe sheet by a perforated tear line. The exact location of the leading edge of the upper most sheet in the stack may not be easily identified, either visually or tacitly. This is partly due to the fact that the substrate material of the wet wipe is typically homogeneous and thus the leading edge of the wet wipe, particularly when folded, can be hard to distinguish from the substrate material on which it rests. In addition, the leading edge portion of the wet wipe has a tendency to adhere to the underlying wet wipe substrate material on which it rests. Hence, even tactile identification of the edge by running or dragging of the fingers across the surface of the wet wipe does not immediately result in the identification of the location of the edge.

A second problem is that once the leading edge is located, it may be difficult for the consumer to grasp hold of sufficient substrate material and maintain a grasp thereof in order to separate a single wet wipe sheet from the stack upon which it rests. The consumer often is only able to grasp a small portion of the leading edge such that a tight grip thereof is not established and hence the wet wipe sheet easily slips from the fingers of the consumer.

Other factors contributing to the problem of single wet wipe dispensing include the tendency of the wet wipe substrate material to adhere to itself. This is partially due to the compression of the stack of wet wipes during manufacturing and storage. The existence of an attractive force between adjacent wet wipe sheets is compounded by the liquid solution used to impregnate the substrate material. Wet materials tend to adhere to themselves. In addition, the actual weight of the stack of wet wipes tends to keep it together. As a result, when the wet wipes are folded or interleaved together to form a stack, the substrate material tends to adhere to itself and to the substrate material of adjacent sheets. Furthermore, when the wet wipe are interleaved or joined together by a tear line, such as a perforation line, additional resistance is created since a force is needed to overcome the connection between adjacent wet wipe sheets.

Now a dispenser has been invented that will facilitate single wet wipe separation from the stack and removal of a single wet wipe from the dispenser without encountering the above-identified problems.

SUMMARY OF THE INVENTION

Briefly, this invention relates to a dispenser which can house a plurality of folded wet wipes, each having a width. The dispenser includes first and second members pivotally connected together to form an enclosed dispenser having a transverse axis. The first and second members are formed from a semi-rigid material. The dispenser has a height of about 2.5 inches or less and has a top wall with an entrance formed therein. The entrance has a surface area of from between about 15 $cm^2$ to about 95 $cm^2$. The folded wet wipes have a normalized separation force between two adjacent wet wipes of less than about 65 g/cm. The entrance also has a dimension, measured along the transverse axis, that when divided by the width of one of the folded wet wipes is at least about 0.7.

DETAILED DESCRIPTION

Figure 1:
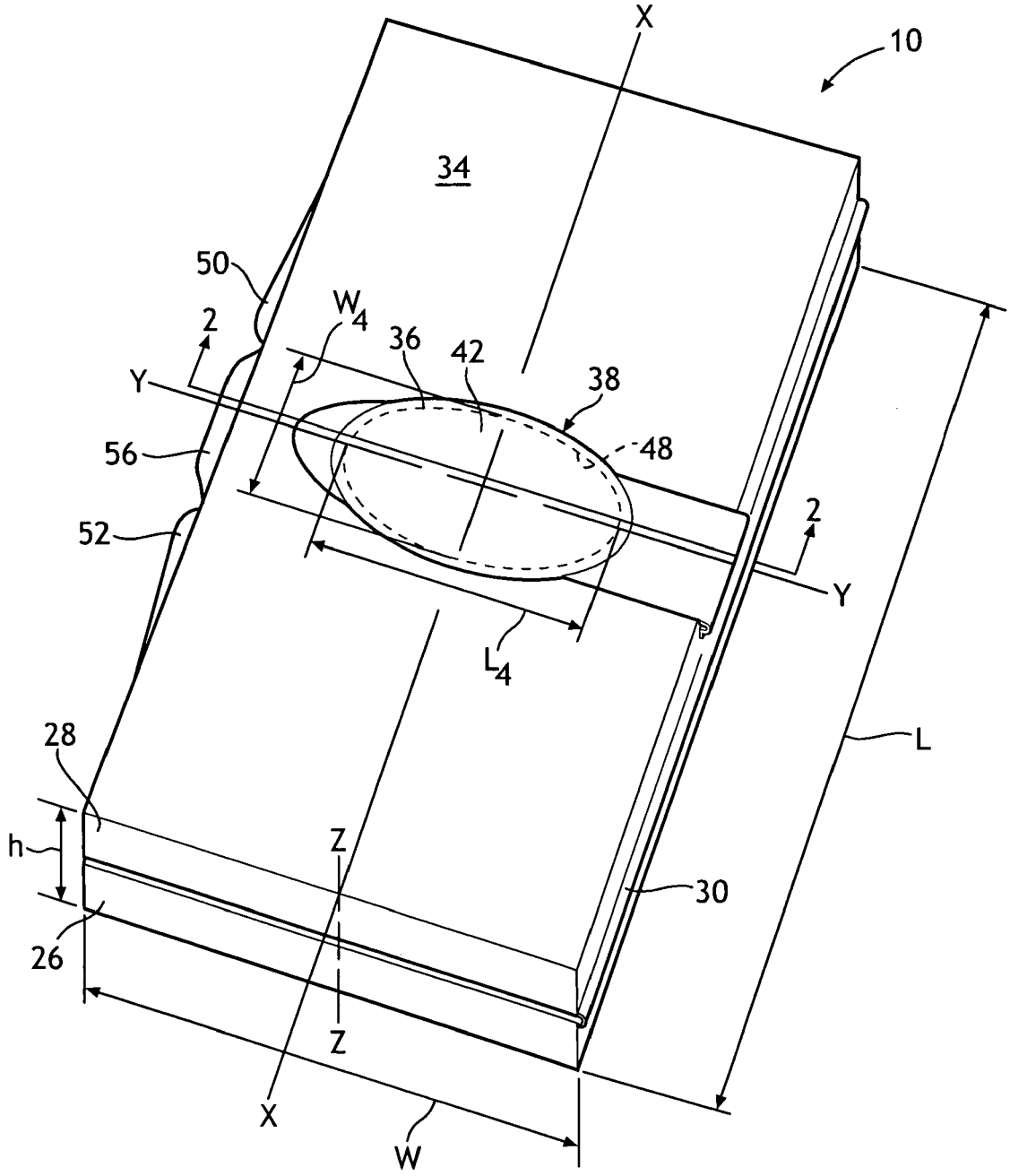
FIG. 1 is a perspective view of a dispenser showing the first and second members in a closed position and pivotally connected by a hinge and depicting an entrance formed in the top wall of the dispenser through which the wet wipes can be removed.
Figure 2:
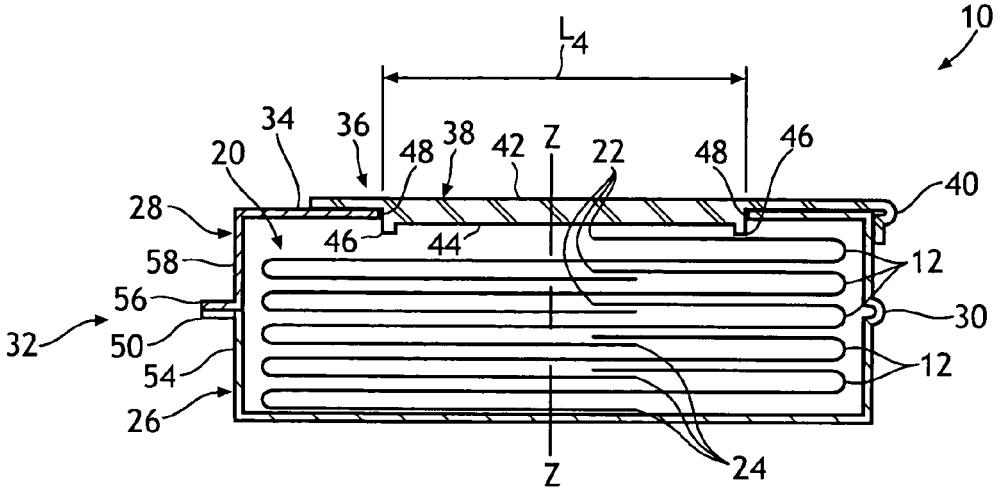
FIG. 2 is a cross-sectional view of FIG. 1 taken along line 2—2 showing a plurality of wet wipes housed in the dispenser.

Referring to FIGS. 1 and 2, a dispenser 10 is shown which is capable of housing, storing and dispensing a plurality of sheets of wet wipes 12, from two locations. The dispenser 10 has a generally rectangular configuration with a longitudinal central axis X—X, a transverse central axis Y—Y and a vertical axis Z—Z. The dispenser 10 also has an overall length L, a width w and a height h. The dimensions of the dispenser 10 can vary to suit one's particular needs. The overall size of the dispenser 10 can be selected so as to be slim enough to easily fit into a woman's purse, into a diaper bag, into a glove compartment of a car, into a desk drawer, etc. The dispenser 10 may also fit into the enlarged pocket of an overcoat. The dispenser 10 is reusable and is capable of being refilled multiple times during its life. For the dispenser 10, the dimensions can range from between about 6 inches (about 15 centimeters (cm)) to about 12 inches (about 30 cm) in overall length L, from between about 3 inches (about 7.6 cm) to about 6 inches (about 15 cm) in width w, and have a height h equal to or less than about 2.5 inches (about 6.4 cm). More desirably, the dispenser 10 can range from between about 7 inches (about 18 cm) to about 10 inches (about 25 cm) in overall length L, from between about 3.5 inches (about 8.9 cm) to about 5 inches (about 12.7 cm) in width w, and have a height h equal to or less than about 2 inches (about 5 cm). Most desirably, the dispenser 10 will have a height h equal to or less than about 1.5 inches (about 3.8 cm). Even more desirably, the dispenser 10 will have a height h equal to or less than about 1 inch (about 2.5 cm).

The dispenser 10 is designed to house and store a plurality of wet wipes 12 in a water resistance environment. The dispenser 10 will allow the wet wipes 12 to retain their moisture until the user is ready to withdraw and use the wet wipes 12. The wet wipes 12 can be removed from the dispenser 10 either individually or as a group of two or more.

Figure 3:
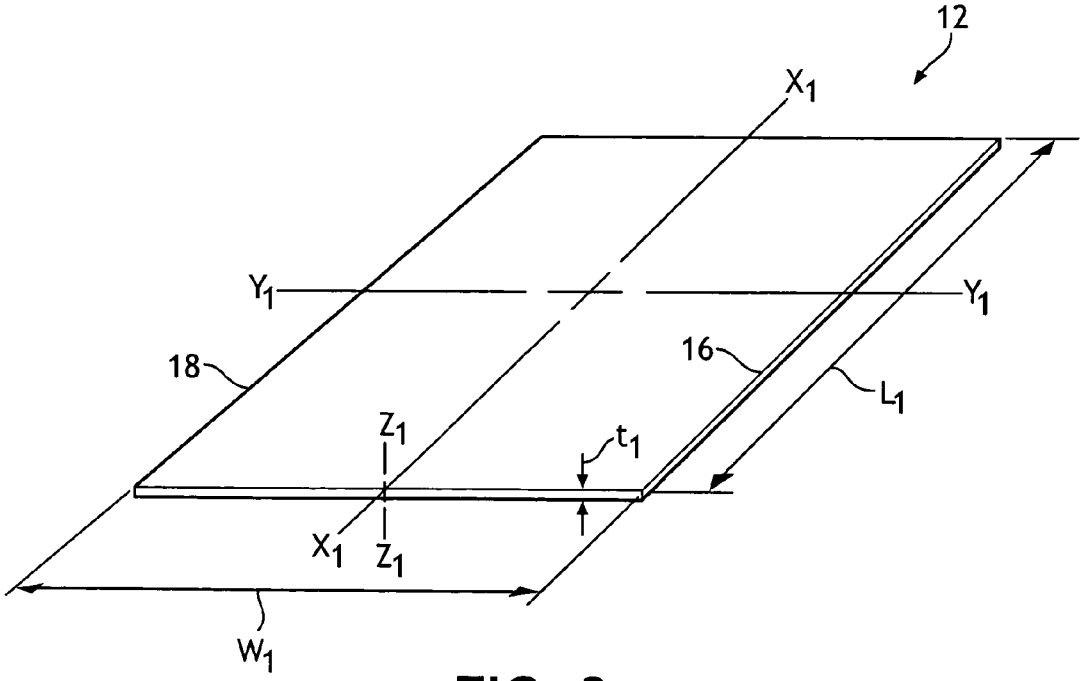
FIG. 3 is a perspective view of a single wet wipe.

Referring to FIG. 3, a single wet wipe 12 is shown having a longitudinal central axis $X_1$—$X_1$, a transverse central axis $Y_1$—$Y_1$, and a vertical axis $Z_1$—$Z_1$. By a "wet wipe" it is meant a relatively flat sheet that is moist or wet to the touch and is impregnated with a liquid solution. A wet wipe can include a pre-moistened sheet, a pre-moistened facial tissue, a wet towel, a wet towelette, an impregnated sheet, a hand wipe, a baby wipe, etc. Each wet wipe 12 can have any desired geometrical cross-sectional configuration. Desirably, each wet wipe 12 will have either a square or rectangular cross-sectional shape. The wet wipe 12 has a length $L_1$, a width $w_1$ and a thickness $t_1$. The length $L_1$, width $w_1$ and thickness $t_1$ dimensions can vary depending upon one's particular needs and desires. The length $L_1$ and width $w_1$ dimensions can each range from between about 5 inches (about 12.7 centimeters (cm)) to about 10 inches (about 25.4 cm). Desirably, the length $L_1$ and width $w_1$ dimensions will each range from between about 6 inches (about 15.2 cm) to about 9 inches (about 23 cm). More desirably, the length $L_1$ and width $w_1$ dimensions will each range from between about 7 inches (about 17.8 cm) to about 9 inches (about 20.3 cm). The thickness $t_1$ dimension will usually range from between about 0.4 millimeters (mm) to about 5 mm. Desirably, each wet wipe 12 will have a thickness $t_1$ that ranges from between about 0.5 mm to about 3.5 mm. More desirably, each wet wipe 12 will have a thickness $t_1$ that ranges from between about 0.6 mm to about 3 mm. For example, one commercially available wet wipe has a length $L_1$ of about 7.5 inches (about 19 cm), a width $w_1$ of about 7.5 inches (about 19 cm) and a thickness $t_1$ of less than about 1 mm, when it is in a non-folded state. In this wet wipe product, the length $I_1$ and the width $w_1$ dimensions are equal; however, they do not have to be equal for purposes of this invention.

Each wet wipe 12 consist of a substrate that is impregnated with a liquid solution. The substrate may be produced by any method known to those skilled in the art. For example, nonwoven substrates can be formed by dry forming techniques such as air-laying or wet laying such as on a paper making machine. Other nonwoven manufacturing techniques such as air-laid, melt blown, spun bonded, needle punched and spun laced methods may also be used. Hydroentangling is a method that can also be employed.

The substrate may be formed of one or more layers and from one or more materials. When more than one layer is utilized, the layers may be identical in terms of composition and or manufacturing techniques or consist of a combination of different materials. A good material from which the substrate can be formed is coform. Coform is a composite material containing meltblown microfibers and cellulose (wood) fibers. A desirable mixture includes about 5% to about 95% polypropylene and about 95% to about 5% cellulose fibers. Coform is commercially produced by Kimberly-Clark Corporation having an office at 401 North Lake Street, Neenah, Wis. 54956.

The substrate material is typically impregnated or coated with a liquid composition. According to this invention, the term "liquid composition" refers to any composition which is in a liquid form when it contacts the substrate. Typically, the composition may be aqueous, alcohol based or an emulsion, either a water-in-oil or an oil-in-water or a multiple emulsion. The emulsion may also contain a lipid phase which can be broken by the application of minimal pressure, for example, by wiping the skin. The composition will contain from about 50% to about 98% by weight water, desirably de-ionized or distilled water, and from about 2% to about 50% by weight of actives. Desirably, the liquid composition will contain at least 97% water. Of the active components, desirably about 2% to about 20% are present in the oil phase and the remainder are present in the aqueous phase.

The composition may include a stability agent or preservative. Stability agents suitable for use herein include phenoxyethanol desirably in the range of from about 0.1% to about 1.0%, sodium benzoate, potassium sorbate, methylparaben, propylparaben, ethylparaben, butylparaben, sodium benzoate, potassium sorbate, benzalkonium chloride, and disodium salt ethylene-diamine tetraacetic acid (EDTA) or other EDTA salts (sequestrenes). Sequestrene is a series of complexing agents and metal complexes general of ethylenediamine-tetraacetic acid and salts. The total quantity of stability agents should be in the range of about 0.1% to about 4.0% by weight of the composition.

The composition of the present invention may further include from about 0.02% to about 5.0% by weight of an emollient or moisturizer. Desirably, the emollient is water soluble and includes polyhydric alcohols, such as propylene glycol, glycerin, and also water soluble lanolin derivatives.

Further optional ingredients which may be used in the composition include: anti fungal agents, antibacterial agents, skin protectants, oil soluble cleansing agents, water soluble surfactants or detergents, desirably nonionic or amphoteric, pH adjusters, perfumes, fragrances and the like.

In preparing the wet wipe 12, the liquid composition is applied to at least one surface of the substrate material. The liquid composition can be applied at any time during the manufacture of the wet wipe 12. Desirably, the liquid composition can be applied to the substrate after the substrate has been dried. Any variety of application methods that can evenly distribute lubricious materials having a molten or liquid consistency can be used. Suitable methods include spraying, printing, (e.g. flexographic printing), coating (e.g. gravure coating or flood coating), extrusion whereby the composition is forced through tubes into contact with the substrate whilst the substrate passes across the tube, or combinations of the above techniques.

The liquid composition can also be applied non-uniformly to one or more surfaces of the substrate. By "non-uniformly" it is meant that the amount and/or pattern of distribution of the liquid composition can vary over the surface(s) of the substrate. For example, some of a surface of the substrate can have a greater or lesser amount of the liquid composition, including portions of the surface that do not have any composition on it.

Figure 4:
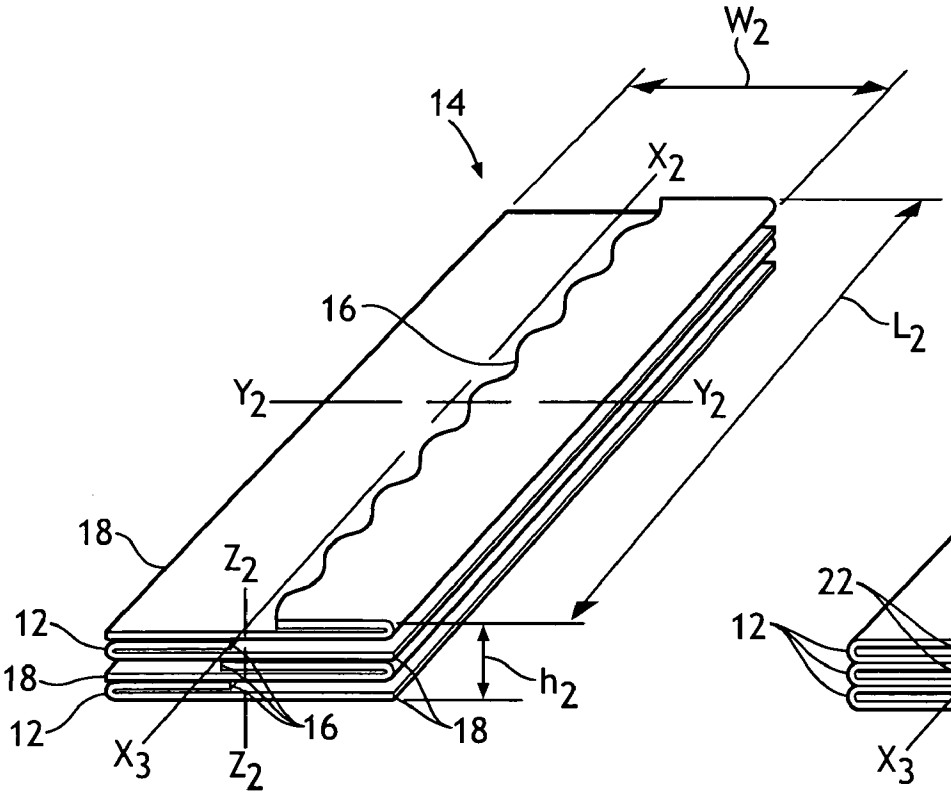
FIG. 4 is a perspective view of a plurality of J-folded wet wipe sheets arranged one on top of another to form a stack of wet wipes that can be housed in the dispenser shown in FIG. 1.

Referring now to FIG. 4, a plurality of folded wet wipes 12 is shown arranged in a stack 14. By "stack" it is meant a quantity, a pile, an arrangement or group of three or more wet wipe 12. Each stack 14 can include an orderly arrangement and can include up to eighty (80) or more wet wipe 12. Desirably, each stack 14 will contain from about eight (8) to about fifty (50) wet wipe 12. More desirably, each stack 14 will contain from about eight (8) to about forty (40) wet wipe 12. Most desirably, each stack 14 will contain about sixteen (16) wet wipe 12. Typically, each of the wet wipes 12 is folded either before or during the process of being arranged into the stack 14. In FIG. 4, each of the wet wipe 12 are J-folded and arranged one on top of another with the J-fold staggered so as to form an approximately uniform stack height $h_2$. The stack height $h_2$ is less than the height h of the dispenser 10.

The stack 14 has a longitudinal central axis $X_2$—$X_2$, a transverse central axis $Y_2$—$Y_2$, and a vertical axis $Z_2$—$Z_2$. In the stack 14, each of the wet wipe 12 has a length $L_2$, a width $w_2$ and a height $h_2$. The length $L_2$ is shown being equal to the initial length $L_1$ of the single wet wipe 12 shown in FIG. 3. However, each of the wet wipes 12 can be folded lengthwise, if desired. The width $w_2$ of the folded wet wipe 12 is less than the initial unfolded width $w_1$. Normally, the folded width $w_2$ is from between about 10% to about 50% less than the initial width $w_1$. The actual width $w_2$ of each of the folded wet wipes 12 can range from between about 1 inch (about 2.5 cm) to about 5 inches (about 12.7 cm). More desirably, the width $w_2$ of each of the folded wet wipes 12 will range from between about 2 inches (about 5 cm) to about 4 inches (about 10 cm). More desirably, the width $w_2$ of each of the folded wet wipes 12 will be about 3.75 inches (about 9.5 cm).

Each of the wet wipes 12 has a leading or upper edge 16 and a trailing or lower edge 18. The leading or upper edge 16 is designed to be easily grabbed or snatched by reaching into the dispenser 10 with one or more fingers and the thumb. The leading or upper edge 16 can be located along the longitudinal central axis $X_2$—$X_2$ of the stack 14 or be located on either side of it. It is also advantageous that the leading or upper edge 16 be visibly apparent. To aid in making the leading edge 16 more visually apparent, it can be formed to have a non-linear configuration. For example, a scallop shape design is depicted in FIG. 4. The scallop edge 16 consists of a series of semicircular curved projections forming an ornamental border. The scallop design makes the upper edge 16 more visible to the ultimate consumer and the scallop design can also aid in allowing the user to grab the wet wipe 12. Other non-linear profiles can also be used.

It should also be noted that the leading or upper edge 16 of each of the wet wipes 12 could be colored or have a color printed thereon to make the edge 16 more visually apparent to the consumer. Other means known to those skilled in the art for making the leading edge 16 more visual can also be utilized.

Figure 5:
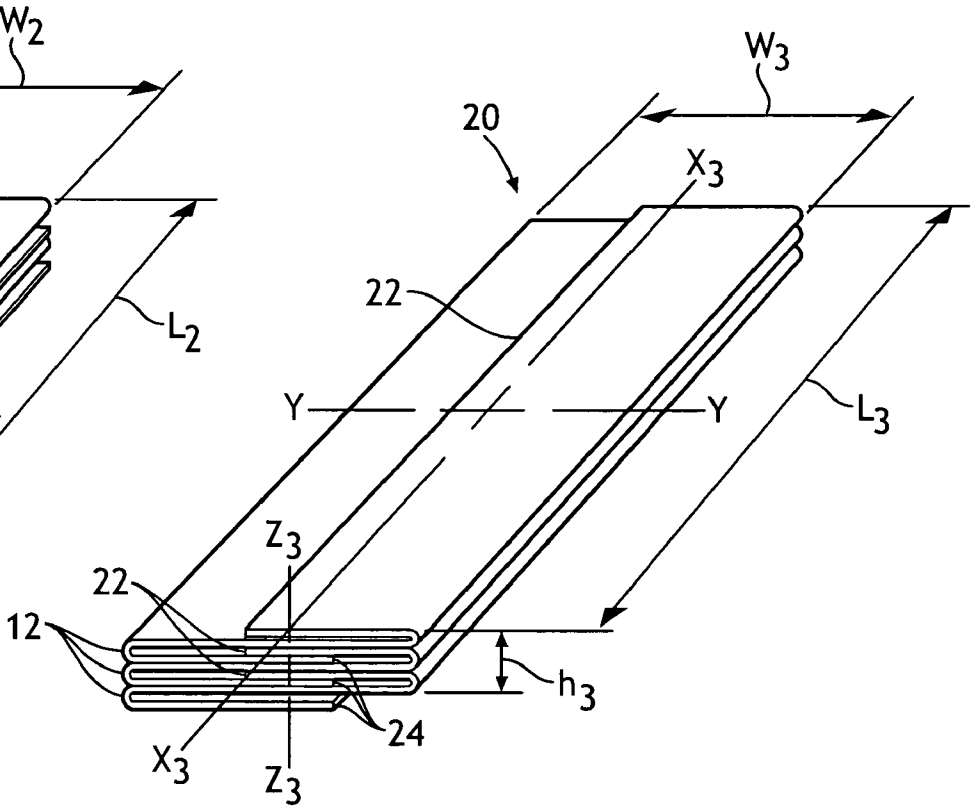
FIG. 5 is a perspective view of a plurality of Z-folded wet wipe sheets which are interleaved to form a stack of wet wipes that can be housed in the dispenser shown in FIG. 1.

Referring now to FIG. 5, another configuration of a stack 20 of a plurality of wet wipes 12 is shown. The word "stack" has been defined above. In the stack 20, each of the wet wipes 12 is Z-folded and interleaved together so as to form an approximately uniform stack height $h_3$. The stack height $h_3$ is less than the height h of the dispenser 10. The stack 20 has a longitudinal central axis $X_3$—$X_3$, a transverse central axis $Y_3$—$Y_3$, and a vertical axis $Z_3$—$Z_3$. In the stack 20, each of the wet wipes 12 has a length $L_3$, a width $w_3$ and a height $h_3$. The length $L_3$ is shown being equal to the initial length $L_1$ of the single wet wipe 12 shown in FIG. 3. However, each of the wet wipes 12 can be folded lengthwise, if desired. The width $w_3$ is less than the initial unfolded width $w_1$. Normally, the folded width $w_3$ is from between about 10% to about 50% less than the initial width $w_1$. The actual width $w_3$ of each of the folded wet wipes 12 can range from between about 1 inch (about 2.5 cm) to about 5 inches (about 12.7 cm). More desirably, the width $w_3$ of each of the folded wet wipes 12 will range from between about 2 inches (about 5 cm) to about 4 inches (about 10 cm). More desirably, the width $w_3$ of each of the folded wet wipes 12 will be about 3.75 inches (about 9.5 cm).

Each of the wet wipes 12 has a leading or upper edge 22 and a trailing or lower edge 24. The leading or upper edge 22 is designed to be easily grabbed or snatched by reaching into the dispenser 10 with one or more fingers and the thumb. The leading or upper edge 22 can be located along the longitudinal central axis $X_2$—$X_2$ of the stack 20 or be located on either side of it. It is also advantageous that the leading or upper edge 2 be visibly apparent. To aid in making the leading edge 22 more visually apparent, it can be formed as a linear line but could be angled relative to the longitudinal central axis $X_3$—$X_3$ of the stack 20, if desired. The stack 20 also includes an orderly arrangement of the wet wipes 12, as was explained above with reference to the stack 14. The number of wet wipes 12 making up the stack 20 can also be of the quantity recited above.

It should be noted that each of the wet wipes 12 in the stack 20 is interleaved or sandwiched between a portion of an adjacent wet wipe 12 such that as the upper most wet wipe sheet 12 is removed from the stack 20, the subsequent wet wipe 12 will be exposed and have its upper edge 22 available to be grabbed or snatched.

It should be noted that the wet wipes 12 can be constructed from an absorbent or a non-absorbent material. By "absorbent" it is meant that each of the wet wipes 12 is capable of absorbing a liquid, a chemical solution, a non-solid substance, etc. An example of a liquid is water, an example of a chemical solution is mouthwash, and an example of a non-solid substance is a makeup cream. The wet wipes 12 can be oriented in the dispenser 10 in a relatively flat arrangement or be folded in some fashion. The longitudinal axis $X_2$—$X_2$ or $X_3$—$X_3$ of the folded wet wipes 12 should be aligned essentially parallel to the longitudinal axis X—X of the dispenser 10, see FIG. 1. This orientation will facilitate removal of the wet wipes 12 from the dispenser 10. Common ways to fold the wet wipes 12 include, but are not limited to, C-folds, J-folds, Z-folds, etc.

The wet wipes 12 can be formed from synthetic or natural fibers or a combination of such fibers. Cotton and wood pulp fibers are two examples of natural fibers. Synthetic fibers can include polyolefin fibers, such as polypropylene and polyethylene fibers. The wet wipes 12 can be moistened with an aqueous composition which contains amongst others things, surfactants, preservatives, lotions, solutions, oils, medication, scents, fragrances, etc. or any combination thereof. One example of a baby wet wipe is HUGGIES ORIGINAL® which is a registered trademark of Kimberly-Clark Corporation having an office at 401 North Lake Street Neenah, Wis. 54956. This wet wipe contains water, potassium laureth phosphate, glycerin, polysorbate 20, tetrasodium EDTA, DMDM hydantoin, methylparaben, malic acid and a fragrance. The wet wipes 12 are typically packaged in the dispenser 10 to facilitate easy storage, transport and retrieval of the wet wipes 12 for various uses.

The dispenser 10 is unique in that it allows the wet wipes 12 to be removed or withdrawn either individually or as a group of two or more articles. One or more of the wet wipes 12 can be removed through a first entrance by reaching into the dispenser 10 or an individual wet wipe 12 can be withdrawn through a second entrance in a pop-up fashion. This will be explained in greater detail below. The dispenser 10 can be manufactured in various sizes and shapes and can be constructed from a variety of materials. The dispenser 10 can be constructed from a relatively semi-rigid or rigid material. By "semi-rigid or rigid" it is meant a material that will maintain its overall shape and will not substantially deform when normally handled for its intended purpose. A "semi-rigid or rigid" material has a thickness of at least about twenty thousandths (0.020) of an inch. Desirably, a semi or rigid material will have a thickness equal to or greater than about thirty thousandths (0.030) of an inch. More desirably, a semi or rigid material will have a thickness equal to or greater than about forty thousandths (0.040) of an inch. The dispenser 10 can be formed from almost any type of material. A desirable material from which the dispenser 10 can be formed is a thermoplastic material. The thermoplastic can be a polyolefin such as polypropylene, polyethylene, polystyrene, acrylonitryl butadiene styrene, polyester, polyvinyl chloride, polycarbonate, high density polyethylene, or a copolymer formed therefrom. Other kinds of thermoplastics can also be used. Desirably, the dispenser 10 is formed from polypropylene. The dispenser 10 can also be formed from ferrous and nonferrous metals, metal alloys, aluminum, wood, plywood, wood veneer, thick cardboard, a laminate of different kinds of plastics, a combination of plastic and paper laminates, plastic film laminates, thermoplastic strands inserted into a laminate, or a combination thereof. In addition, other kinds of semi-rigid materials known to those skilled in the art can also be used.

It should be noted that very flexible materials having a thickness of less than about 0.4 mm are not interpreted as being a "semi-rigid or rigid" material. Flexible wrapping material such as aluminum foil, thin plastic films, very thin laminates, paper bags, etc. are not considered to be semi-rigid materials.

Desirably, the dispenser 10 is formed from a thermoplastic material that can be injection molded. Normally, the injection molded material will have a thickness ranging from between about 0.5 mm to about 6 mm. More desirably, the injection molded material will have a thickness ranging from between about 0.6 mm to about 5 mm. Most desirably, the injection molded material will have a thickness ranging from between about 0.75 mm to about 2 mm.

Referring again to FIGS. 1 and 2, the dispenser 10 includes a first member 26 and a second member 28. The first and second members, 26 and 28 respectively, are hollow members having a depth dimension and each having an open surface or wall. Each of the first and second members, 26 and 28 respectively, is capable of holding or retaining a quantity of the wet wipes 12. Each of the first and second members, 26 and 28 respectively, has a thickness of at least about twenty (0.020) thousandths of an inch. The first and second members, 26 and 28 respectively, are pivotally connected by a hinge 30. As stated above, the first and second members, 26 and 28 respectively, can be formed by injection molding. By injection molding the first and second members, 26 and 28 respectively, together, they can be integrally formed as a single entity. The hinge 30 can also be injection molded along with the first and second members, 26 and 28 respectively. The hinge 30 can be a living hinge. By a "living hinge" it is meant a hinge that is integrally formed with and constructed from the same material as was used to form the first and second members, 26 and 28 respectively. Usually, a living hinge has a smaller thickness relative to the overall thickness of the two members to which it is connected.

As shown in FIG. 1, the dispenser 10 is depicted as a slim travel pack that can be initially filled with a plurality of wet wipes 12. The dispenser 10 has a height "h" which can be equal to or less than about 2.5 inches (about 6.4 centimeters). Desirably, the height "h" of the dispenser 10 will range from between about 0.5 inches (about 1.3 centimeters) to about 2 inches (about 5 centimeters). More desirably, the dispenser 10 has a height "h" of about 1.5 inches (about 3.8 centimeters). Even more desirably, the dispenser 10 will have a height "h" of about 1 inch (about 2.5 centimeters). As explained above, the wet wipes 12 can be stacked in the dispenser 10 in an interleaved or non-interleaved array. In either case, the upper edge 16 or 22 of each wet wipe 12 should extend lengthwise, essentially parallel to the longitudinal central axis X—X of the dispenser 10.

Still referring again to FIGS. 1 and 2, the first and second members, 26 and 28 respectively, are hinged together and can pivot or rotate between a close position, shown in FIGS. 1 and 2, and an open position, not shown. When the second member 28 is pivoted on the hinge 30 to an open position, a first entrance 32, the location of which is denoted by the lead line and arrow extending from the numeral 32, is formed in the dispenser 10. When the second member 28 is so pivoted at least 90 degrees relative to the first member 26, the first entrance 32 will be equal to or larger than the entire upper surface of the exposed stack 20 of wet wipes 12. The length $I_3$ and the width $w_3$ of the stack 20 of wet wipes 12 are less than the overall length L and the width w of the dispenser 10. This size difference is important for it permits the consumer to easily reach-in with his or her hand and grab or snatch as many of the wet wipes 12 as he or she wishes. It should be readily apparent to the reader that the first entrance 32 allows for one or more of the wet wipes 12 to be removed or withdrawn at a single time. In fact, the entire stack 20 of wet wipes 12 could be withdrawn by the user at one time, if desired.

Continuing to refer to FIGS. 1 and 2, the second member 28 of the dispenser 10 includes a top wall 34 having an entrance 36 formed therein. The entrance 36 will be referred to as the second entrance to distinguish it from the first entrance 32. The second entrance 36 is shown as an aperture formed completely through a top wall 34. Desirably, the top wall 34 is a planar surface which is vertically oriented relative to the upper surface of the stack 20 of wet wipes 12. The second entrance 36 has a surface area that can range from between about 15 $cm^2$ to about 95 $cm^2$. Desirably, the second entrance 36 has a surface area that can range from between about 15 $cm^2$ to about 70 $cm^2$. More desirably, the second entrance 36 has a surface area that can range from between about 20 $cm^2$ to about 50 $cm^2$. Most desirably, the second entrance 36 has a surface area that can range from between about 20 $cm^2$ to about 40 $cm^2$.

The second entrance 36 is depicted as being aligned along both the longitudinal and transverse axes, X—X and Y—Y respectively, of the dispenser 10. In fact, the intersection of the longitudinal and transverse axes, X—X and Y—Y respectively, forms the center of the second entrance 36. It should be noted that the second entrance 36 can be offset from the longitudinal and transverse axes, X—X and Y—Y respectively, if desired. The second entrance 36 is shown being elliptical or oval in configuration, although other geometrical configurations could also be used. Examples of various profiles for the second entrance 36 include but are not limited to: a round or circular opening, a semi-circular opening, a square opening, a rectangular opening, etc. The elliptically shaped second entrance 36 has a length $l_4$ measured along its major axis and a width $w_4$ measured along its minor axis. The length $l_4$ of the second entrance 36 is shown aligned approximately parallel to the transverse central axis Y—Y of the dispenser 10. Likewise, the width $w_4$ of the second entrance 36 is shown aligned approximately parallel to the longitudinal central axis X—X of the dispenser 10. Other orientations are also possible. For example, the largest dimension of the second entrance 36 can be aligned approximately parallel to the transverse axis Y—Y of the dispenser 10, approximately perpendicular to the transverse axis Y—Y of the dispenser 10, or be aligned at an angle to the transverse axis Y—Y of the dispenser 10.

The dimensions of the second entrance 36 should be selected to ensure that the wet wipes 12 can be individually removed from the dispenser 10. The second entrance 36 should have a transverse dimension, measured parallel to the transverse axis Y—Y, (which is the length $l_4$ for the orientation shown in FIGS. 1 and 2) that is at least about 60% of the width w of the dispenser 10. For example, if the width w if the dispenser is 10.5 cm, then the transverse dimension, measured parallel to the transverse axis Y—Y, of the second entrance 36 should be at least about 6.3 cm. Another way of describing the dimension of the second entrance 36 when measured parallel to the transverse axis Y—Y, is to compare it to the width $w_2$ or $w_3$ of the folded wet wipes 12. Desirably, the second entrance 36 has a dimension (the length $L_4$ for the orientation shown in FIGS. 1 and 2) which ranges from between about 60% to 150% of the width $w_2$ or $w_3$ of the folded wet wipes 12. More desirably, the second entrance 36 has a dimension, when measured parallel to the transverse axis Y—Y, which ranges from between about 70% to 100% of the width $w_2$ or $w_3$ of the folded wet wipes 12. Most desirably, the second entrance 36 has a dimension, when measured parallel to the transverse axis Y—Y, which ranges from between about 75% to 95% of the width $w_2$ or $w_3$ of the folded wet wipes 12. For example, if the folded wet wipes 12 have a width of about 3.5 inches (about 8.9 cm), then the second entrance 36 should have a dimension, measured parallel to the transverse axis Y—Y, of at least about 2.1 inches (about 5.3 cm).

In addition, the second entrance 36 should have a dimension measured along the longitudinal axis X—X (the width $w_4$ for the orientation shown in FIGS. 1 and 2) which is at least about 0.75 inches (about 1.9 cm) in order to accommodate the width of a user's thumb and index finger. Desirably, the second entrance 36 has a dimension measured along the longitudinal axis X—X which ranges from between about 0.75 inches (about 1.9 cm) to about 100% of the length $L_2$ or $L_3$ of the folded wet wipe 12. More desirably, the second entrance 36 has a dimension measured along the longitudinal axis X—X which ranges from between about 1 inch (about 2.5 cm) to about 80% of the length $L_2$ or $L_3$ of the folded wet wipe 12. Still more desirably, the second entrance 36 has a dimension measured along the longitudinal axis X—X which ranges from between about 1 inch (about 2.5 cm) to about 60% of the length $L_2$ or $L_3$ of the folded wet wipe 12. Most desirably, the second entrance 36 has a dimension measured along the longitudinal axis X—X which ranges from between about 1 inch (about 2.5 cm) to about 30% of the length $L_2$ or $L_3$ of the folded wet wipe 12. In terms of actual dimensions, as measured along the longitudinal axis X—X, the second entrance 36 can range from about 0.75 inches to about 7.5 inches (about 19 cm) for a folded wet wipe 12 that has an overall length $L_2$ or $L_3$ of about 7.5 inches (about 19 cm). Another example would be a second entrance 36 that has a dimension measured along the longitudinal axis X—X which ranges from between about 1 inch (about 2.5 cm) to about 2.25 inches (about 5.7 cm) for a folded wet wipe 12 that has an overall length $L_2$ or $L_3$ of about 7.5 inches (about 19 cm).

Figure 6:
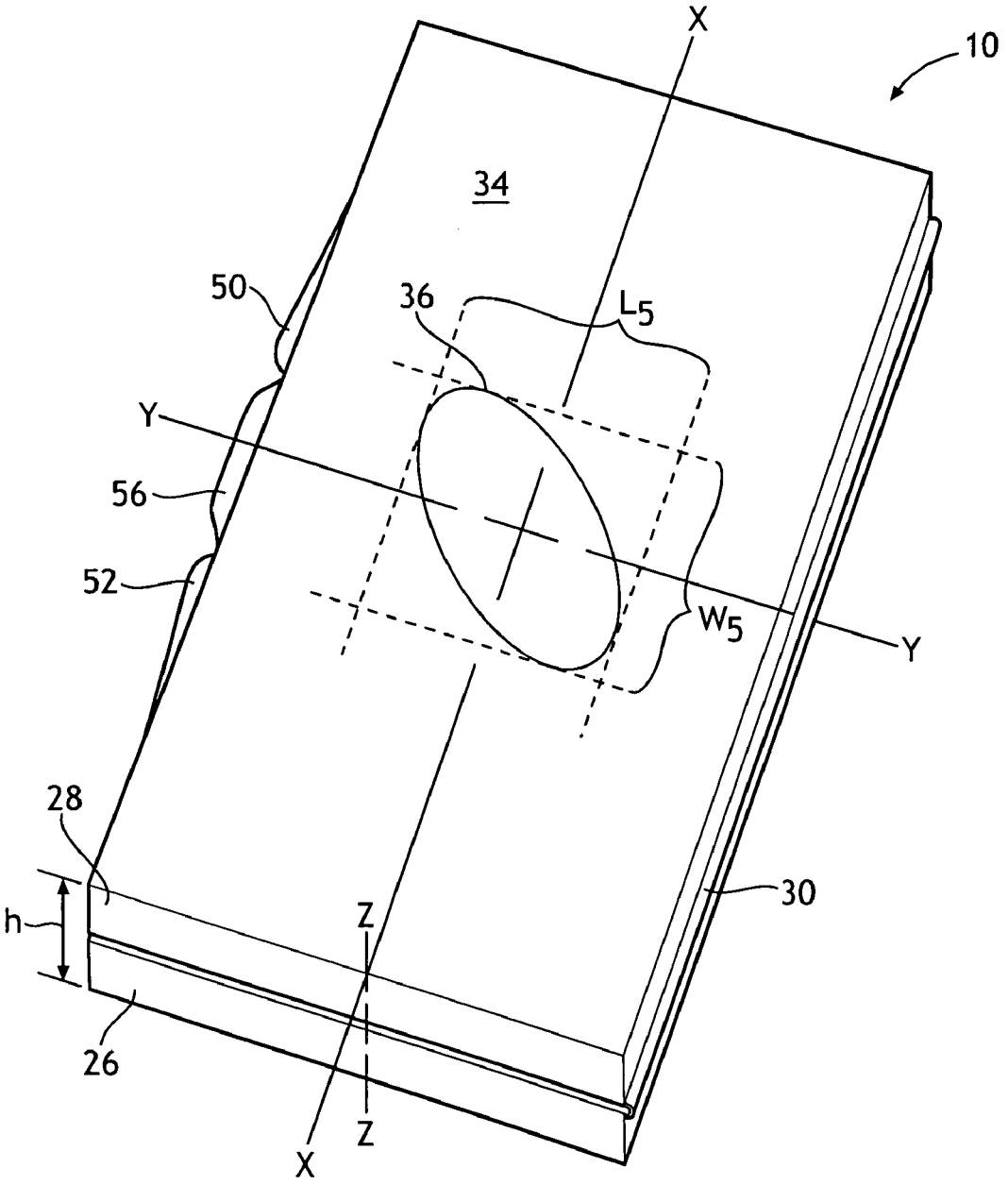
FIG. 6 is a top view of a dispenser having a second entrance formed therein which is aligned at an angle to the transverse axis Y—Y and without the presence of the third member.

Referring to FIG. 6 the second entrance 36 is shown aligned at an angle to the transverse axis Y—Y. It this embodiment, one can draw two lines which will tangentially intersect the opposite ends of the second entrance 36 and they can be extended to perpendicularly intersect the transverse axis Y—Y. The dimension $L_5$ located between these two lines at the transverse axis Y—Y can range from between about 60% of the width w of the dispenser 10. For example, if the width w if the dispenser is 10.5 cm, then the dimension $L_5$, of the second entrance 36 should be at least about 6.3 cm. Another way of describing the dimension $L_5$ of the second entrance 36 is to compare it to the width $w_2$ or $w_3$ of the folded wet wipes 12. Desirably, the second entrance 36 has a dimension $L_5$ which ranges from between about 60% to 150% of the width $w_2$ or $w_3$ of the folded wet wipes 12. More desirably, the second entrance 36 has a dimension $L_5$ which ranges from between about 70% to 100% of the width $w_2$ or $w_3$ of the folded wet wipes 12. Most desirably, the second entrance 36 has a dimension $L_5$ which ranges from between about 75% to 95% of the width $w_2$ or $w_3$ of the folded wet wipes 12. For example, if the folded wet wipes 12 have a width of about 3.5 inches (about 8.9 cm), then the second entrance 36 should have a dimension $L_5$ of at least about 2.1 inches (about 5.3 cm).

Still referring to FIG. 6, when the second entrance 36 is aligned at an angle to the transverse axis Y—Y, one can also draw two lines which will tangentially intersect the opposite ends of the second entrance 36 and they can be extended to perpendicularly intersect the longitudinal axis X—X. The dimension $w_5$ located between these two lines at the longitudinal axis X—X can range from between about 0.75 inches (about 1.9 cm) to about 100% of the length $L_2$ or $L_3$ of the folded wet wipe 12. More desirably, the second entrance 36 has a dimension $w_5$ which ranges from between about 1 inch (about 2.5 cm) to about 80% of the length $L_2$ or $L_3$ of the folded wet wipe 12. Still more desirably, the second entrance 36 has a dimension $w_5$ which ranges from between about 1 inch (about 2.5 cm) to about 60% of the length $L_2$ or $L_3$ of the folded wet wipe 12. Most desirably, the second entrance 36 has a dimension $w_5$ which ranges from between about 1 inch (about 2.5 cm) to about 30% of the length $L_2$ or $L_3$ of the folded wet wipe 12. In terms of actual dimensions, the dimension $w_5$ can range from between about 0.75 inches to about 7.5 inches (about 19 cm) for a folded wet wipe 12 that has an overall length $L_2$ or $L_3$ of about 7.5 inches (about 19 cm). Another example would be a second entrance 36 that has a dimension $w_5$ which ranges from between about 1 inch (about 2.5 cm) to about 2.25 inches (about 5.7 cm) for a folded wet wipe 12 that has an overall length $L_2$ or $L_3$ of about 7.5 inches (about 19 cm).

Still referring to FIGS. 1 and 2, the dispenser 10 further includes a third member 38 which is secured to the second member 28 by a hinge 40. The hinge 40 is shown being spaced apart and aligned parallel to the hinge 30. If desired, the two hinges 30 and 40 and be coaxially aligned relative to one another. The third member 38 is capable of pivoting on the hinge 40 to move from a closed position, as depicted in FIGS. 1 and 2, to an open position, not shown. In the closed position, the third member 38 completely covers or closes off the second entrance 36. The third member 38 can be pivoted or rotated back away from the second entrance 36 through an angle of more than 90 degrees to a position wherein the second entrance 36 is completely open. In this orientation, the user can easily insert his or her thumb and index finger into the second entrance 36 and grab the upper edge 22 of the wet wipes 12. The uppermost wet wipe 12 can then be individually withdrawn through the second entrance 36 and be removed from the dispenser 10.

The third member 38 can be of almost any geometrical configuration but is depicted as having an elliptical or oval shape so as to conveniently nest over the second entrance 36. The top wall 34 of the second member 28 can be recessed in an area where the third member 38 will close over the second entrance 36. The third member 38 has an exterior or upper surface 42 and an interior or lower surface 44, see FIG. 2. The exterior surface 42 of the third member 38 can be flush with the top wall 34 of the second member 28 when in a closed position, if desired. The third member 38 also contains a shoulder 46 that projects downward from the inner surface 44 and engages with the inner periphery 48 of the second entrance 36 when the third member 38 is in its closed position. This engagement of the shoulder 46 with the inner periphery 48 forms a tight or interference fit with the second entrance 36. Such a tight or interference fit will secure the third member 38 to the second member 28 and ensure that a seal is formed about the second entrance 36. This seal establishes a moisture barrier and acts to prevent the liquid solution that was used to impregnate the wet wipes 12 from escaping or evaporating.

The third member 38 can also contain a locking mechanism, not shown, to secure the third member 38 in a closed position over the second entrance 36. One example of a locking mechanism can be a tab and latch located between the second member 28 and the interior or lower surface 44 of the third member 38. As the latch passes over the tab, it will lock the second and third members, 28 and 38 respectively, together.

The elliptical or oval shape of the third member 38 also serves another useful function in that it is sufficiently large to enables the user of the dispenser 10 to use the third member 38 to hold the dispenser 10 stationary. The third member 38 is capable of pivoting or rotating at least about 180 degrees from its closed position. Desirably, the third member 38 can pivot or rotate at least about 225 degrees from its closed position, and more desirably, at least about 270 degrees from its closed position. For example, the user could position his or her elbow, knee or other body part on the third member 38, when it is in an open position having pivoted about 180 degrees from its closed position, to hold the dispenser 10 stationary while removing one or more wet wipes 12. It should be mentioned that if the dispenser 10 is positioned on the edge of a table, the third member 38 can be opened from between about 225 degrees to about 270 degrees from its closed position and the user can position his or her hip or thigh against the third member 38 to hold the dispenser 10 stationary. In addition, when the third member 38 is opened about 180 degrees from its closed position, the consumer can place a diaper bag, a purse or any other heavy object on top of it to hold the dispenser stationary. This ability to use the third member 38 to hold the dispenser 10 stationary without using one's hands is very beneficial.

Still referring to FIGS. 1 and 2, the dispenser 10 also possesses an easy opening mechanism that can be activated with only one hand. This one hand opening feature is obtained by forming a pair of spaced apart finger tabs 50 and 52 on the first member 26. The pair of finger tabs 50 and 52 is positioned along a side wall 54 of the first member 26 which is aligned opposite to the location of the hinge 30. The pair of finger tabs 50 and 52 project outward from the side wall 54 by at least about 0.25 inches (about 0.6 cm). Another finger tab 56 is formed on a side wall 58 of the second member 28. The side wall 58 is also aligned opposite to the location of the hinge 30. The finger tab 56 projects outward from the side wall 58 by at least about 0.25 inches (about 0.6 cm). The finger tab 56 is positioned between or in the middle of the pair of finger tabs 50 and 52. The finer tab 56 can slightly overlap the lower pair of finger tabs 50 and 52, if desired. The finger tab 56 is vertically spaced slightly above the pair of finger tabs 50 and 52. In order to open the first entrance 32 into the dispenser 10, the consumer needs only to press down on one of the outer two finger tabs 50 or 52 with his or her thumb and press up with his or her index finger on the middle finger tab 56. This action will cause the second member 28 to pivot open relative to the first member 26.

It should be noted that, alternatively, the pair of finger tabs 50 and 52 could be formed on the second member 28 and the single finger tab 56 could be formed on the first member 26, if desired. The finger tabs 50, 52 and 56 project outwardly away from the side walls, 54 and 58 respectively, and provide an easy means for the user to open the first entrance 32 into the dispenser 10.

In order to facilitate separation of a single wet wipe 12 from the stack 20 and allow easy removal of the single wet wipe 12 from the dispenser 10, it is beneficial to establish a normalized separation force between adjacent wet wipe sheets 12. This normalized separation force can be obtained by using the test method recited below. It has been found that when the normalized separation force between adjacent wet wipes 12 is less than about 65 g/cm, that individual removal of the wet wipes 12 can be repeatably obtained. Desirably, the normalized separation force between adjacent wet wipes 12 should range from between about 0.25 g/cm to about 65 g/cm grams. More desirably, the normalized separation force between adjacent wet wipes 12 should range from between about 0.5 g/cm to about 65 g/cm grams. More desirably, the normalized separation force between adjacent wet wipes 12 should range from between about 0.75 g/cm to about 65 g/cm grams.

Normalized Separation Force Test Method

This test method measures the normalized separation force required to separate two adjacent sheets of wet wipes in a shear mode. The test results are dependent upon the nature of the substrate, the liquid composition of the solution used to saturate each wet wipe, the folding design of each wet wipe, and the attachment method, if any, for joining two adjacent wet wipes together.

Measuring the Normalized Separation Force

1. A dispenser containing a stack of wet wipes, each in the form of a folded sheet having a width, is obtained directly off an assembly line, from a retail outlet or by other means. The dispenser, which is usually sealed, is opened such that the stack is exposed.

2. Two (2) wet wipes are carefully removed from the stack without disrupting any folds or tear lines, if present. The two wet wipes will be clamped between a pair of jaws of a Sintech (Model 1/G) conventional test machine equipped with TestWorks 3.10 software for Windows. Both the Sintech test machine and the TestWorks software are commercially available from MTS Corporation having an office at 1400 Technology Drive, Eden Prairie, Minn., 55344-2290. The two jaws are initially set at about 2 inches (about 5.0 cm) apart.

3. The leading end of the first wet wipe and the trailing end of the second wet wipe are carefully unfolded about 1 inch (about 2.5 cm) across the entire width of the wet wipes.

4. The center portion of the leading end of the first wet wipe, about 3 inches by 1 inch (about 7.5 cm by 2.5 cm), is clamped to the upper jaw while the center portion of the trailing end of the second wet wipe, about 3 inches by 1 inch (about 7.5 cm by 2.5 cm), is clamped to the lower jaw.

5. The test machine is activated to move the upper jaw (moving jaw) away from the lower jaw (stationary jaw) at a speed of 80 inches per minute (about 200 cm/min.) until the two wet wipes are completely separated.

6. The force in grams (g) as a function of the distance that the moving jaw has traveled in centimeters (cm) is recorded using the TestWorks 3.10 software. The peak load exhibited during the test is designated as the separation force for the two wet wipes. This force value is then normalized as force per unit length (g/cm) by dividing the force by the length of each of the two wet wipes. For example, if the length of each wet wipe is 19 cm (about 7.5 inches), the normalized separation force is equal to the force divided by 19 cm.

It should be noted that if the two wet wipes are joined together by a breakable tear line, for example a perforation line, or some other attachment mechanism, such as one or more spots of adhesive, one or more lines of adhesive, etc. and that this is in addition to the adhesion caused by the liquid composition of the solution used to impregnate the wet wipes 12, that two peak loads will be evident on the recorded graph. The highest peak load exhibited during the test will be the one designated as the separation force for the two wet wipes.

Lastly, it has been found that the smallest dimension (the width $w_4$ for the orientation shown in FIGS. 1 and 2) of the second entrance 36 should be of sufficient size to permit the consumer to easily insert at least his or her thumb and index finger therethrough and grab and remove an individual wet wipe 12 regardless of the height of the stack 14 or 20 and regardless of the location of the leading edge 16 or 22. As wet wipes 12 are removed from the dispenser 10, the height $h_2$ or $h_3$ of the stack, 14 or 20 respectively, will become shorter and the uppermost wet wipe 12 will be located farther away from the second entrance 36. A relationship has been found between the greatest dimension (the length $L_4$ for the orientation shown in FIGS. 1 and 2) of the second entrance 36, measured approximately parallel to the transverse axis Y—Y of the dispenser 10, when divided by the width $w_2$ or $w_3$ of the folded wet wipe 12. This relationship should produce a value of at least about 0.7. Desirably, the value will be at least about 0.75, and more desirably, the value will be at least about 0.8. By adhering to this criterion, one can be assured that individual wet wipes 12 can be removed through the second entrance 36 in a reasonable fashion regardless of how many wet wipes 12 remain in the stack 14 or 20 that is housed in the dispenser 10.

This relationship is not dependent on how many wet wipes 12 are assembled to form the stack 14 or 20 that is housed in the dispenser 10. This relationship is also not dependent on how the wet wipes 12 are folded, interleaved or if adjacent wet wipes 12 are joined by a breakable tear line. Furthermore, this relationship is not dependent on any particular liquid composition which is used to impregnate the substrate used to form the wet wipe 12. Instead, the relationship quantifies the greatest dimension of the second entrance 36, measured parallel to the transverse axis Y—Y of the dispenser 10, divided by the width $w_2$ or $w_3$ of the folded wet wipe 12. By adjusting these two parameters to arrive at a value of at least about 0.7, one can be confident that individual wet wipes 12 can be easily dispensed through the second entrance 36.

While the invention has been described in conjunction with several specific embodiments, it is to be understood that many alternatives, modifications and variations will be apparent to those skilled in the art in light of the aforegoing description. Accordingly, this invention is intended to embrace all such alternatives, modifications and variations that fall within the spirit and scope of the appended claims.

We claim:

1. A dispenser comprising:

a) a first member; and b) a second member pivotally connected to said first member to form an enclosed dispenser having a transverse axis, said first and second members being formed from a semi-rigid material, said dispenser capable of housing a plurality of folded wet wipes each having a width, said dispenser having a height of less than about 2.5 inches and having a top wall with an entrance formed therein, said entrance having a surface area of from between about 15 $cm^2$ to about 95 $cm^2$, said plurality of folded wet wipes having a normalized separation force between adjacent wipes as defined by the test method herein of less than about 65 g/cm, and said entrance has a dimension measured along said transverse axis that when divided by the width of one of said folded wet wipes is at least about 0.7.

2. The dispenser of claim 1 wherein said normalized separation force ranges from between about 0.25 g/cm to about 65 g/cm.

3. The dispenser of claim 2 wherein said normalized separation force ranges from between about 0.5 g/cm to about 65 g/cm.

4. The dispenser of claim 3 wherein said normalized separation force ranges from between about 0.75 g/cm to about 65 g/cm.

5. The dispenser of claim 1 wherein said entrance has a surface area of from between about 15 $cm^2$ to about 70 $cm^2$.

6. The dispenser of claim 5 wherein said entrance has a surface area of from between about 20 $cm^2$ to about 40 $cm^2$.

7. The dispenser of claim 1 wherein said height is less than about 2 inches.

8. The dispenser of claim 1 wherein said entrance has a dimension measured along said transverse axis that when divided by the width of one of said wet wipes is at least about 0.75.

9. The dispenser of claim 1 wherein said entrance has a dimension measured along said transverse axis that when divided by the width of one of said wet wipes is at least about 0.8.

10. A dispenser comprising:

a) a first member; and b) a second member pivotally connected to said first member to form an enclosed dispenser having a transverse axis, said first and second members being formed from a semi-rigid material, said dispenser capable of housing a plurality of folded wet wipes each having a width, said dispenser having a height of less than about 2.5 inches and having a top wall with an entrance formed therein, said entrance having a surface area of from between about 15 $cm^2$ to about 70 $cm^2$, said plurality of folded wet wipes having a normalized separation force between adjacent wipes as defined by the test method herein of from between about 0.25 g/cm to about 65 g/cm, and said entrance has a dimension measured along said transverse axis that when divided by the width of one of said folded wet wipes is at least about 0.75.

11. The dispenser of claim 10 wherein said entrance has a generally elliptical configuration having its largest dimension aligned approximately parallel to said transverse axis.

12. The dispenser of claim 10 wherein said entrance has a generally elliptical configuration having its largest dimension aligned approximately perpendicular to said transverse axis.

13. The dispenser of claim 10 wherein said entrance has a surface area of from between about 20 $cm^2$ to about 40 $cm^2$.

14. The dispenser of claim 10 wherein said each of said wet wipes includes a substrate formed from coform and a liquid composition that contains at least 97% water.

15. The dispenser of claim 10 wherein said first and second members are formed from a thermoplastic material and each has a thickness of at least 0.030 thousandths of an inch.

16. A dispenser comprising:

a) a first member; and b) a second member pivotally connected to said first member to form an enclosed dispenser having a transverse axis, said first and second members being formed from a semi-rigid material, said dispenser capable of housing a plurality of folded wet wipes each having a width, said dispenser having a height of less than about 2.5 inches and having a top wall with an entrance formed therein, said entrance having a surface area of from between about 15 $cm^2$ to about 70 $cm^2$, said plurality of folded wet wipes having a normalized separation force between adjacent sheets as defined by the test method herein of from between about 0.5 g/cm to about 65 g/cm, and said entrance having a dimension measured along said transverse axis that when divided by the width of one of said folded wet wipes is at least about 0.8.

17. The dispenser of claim 16 wherein said normalized separation force ranges from between about 0.75 g/cm to about 65 g/cm.

18. The dispenser of claim 16 wherein said entrance has a surface area of from between about 20 $cm^2$ to about 40 $cm^2$.

19. The dispenser of claim 16 wherein each of said wet wipes includes a substrate formed from coform and a liquid composition that contains at least 97% water.

20. The dispenser of claim 16 wherein said first and second members are formed from a thermoplastic material and each has a thickness of at least 0.020 thousandths of an inch.

21. The dispenser of claim 16 wherein said entrance has a dimension measured along said longitudinal axis that ranges from between about 0.75 inches to about 100% of the length of one of said folded wet wipes.

* * * * *